US005696808A

United States Patent [19]

Lenz

[11] Patent Number: 5,696,808

[45] Date of Patent: Dec. 9, 1997

[54] X-RAY TUBE

[75] Inventor: Eberhard Lenz, Erlangen, Germany

[73] Assignee: Siemens Aktiengesellschaft, Munich, Germany

[21] Appl. No.: 700,029

[22] Filed: Aug. 20, 1996

[30] Foreign Application Priority Data

Sep. 28, 1995 [DE] Germany ..... 195 36 247.0

[51] Int. Cl.[6] ..... H01J 35/00

[52] U.S. Cl. ..... 378/121; 378/101; 378/125

[58] Field of Search ..... 378/101, 121, 378/125

[56] References Cited

U.S. PATENT DOCUMENTS 5,093,853 3/1992 Licht et al. .
5,107,187 4/1992 Miscikowski ..... 378/121

FOREIGN PATENT DOCUMENTS

AS 1 062 828 8/1959 Germany .
OS 195 00 733 8/1995 Germany .

*Primary Examiner*—Craig E. Church
*Attorney, Agent, or Firm*—Hill, Steadman & Simpson

[57] ABSTRACT

An X-ray tube has a vacuum housing, on which is provided a high-voltage terminal connected to the anode. An electrical damping resistor, through which the tube current flows and which is connected between the high-voltage terminal and the anode, is arranged within the vacuum housing. This resistor can be constructed as a component through which the tube current flows, and which connects the anode plate with its mount, such as a rotor in case of a rotating anode X-ray tube. The component has a low electrical conchannelivity so that the connection of the anode plate with the mount has a resistance of at least 250 ohms and at most 15 kiloohms.

13 Claims, 5 Drawing Sheets

X-RAY TUBE

BACKGROUND OF THE INVENTION

1. Field of the Invention

The present invention is directed to an X-ray tube of the type having a vacuum housing on which a high-voltage terminal connected with the anode is provided, and a damping resistor, through which the tube current flows, reconnected to the anode.

2. Description of the Prior Art

It is generally known that uncontrolled discharges, caused by unforeseeable influences, can occur in an X-ray tube. This phenomenon is also called bumping of the X-ray tube.

Since the high-voltage cable leading to a terminal for the X-ray voltage must be shielded for safety reasons, it forms a considerable capacitance (approximately 200 pF/m), which is discharged abruptly in the course of the bumping process. Since the operating voltages for X-ray tubes lie in the kv region, e.g. 50 to 150 kv, considerable energy is stored in high-voltage cable. During the bumping process, very high currents thus flow, of up to 20 kA. Moreover, travelling waves arise in the high-voltage cable. In addition, the currents flowing during the bumping process contain a large portion of high-frequency spectral components which, as a result of the antenna effect of the high-voltage cable, are emitted as high-frequency field disturbances, which are undesirable with regard to electromagnetic compatibility (EMC).

There is a danger of damage to the anode surface due to such high current strengths. As a result of the voltage increases caused by the travelling waves, there is also a danger of damage to the components connected electrically to the X-ray tube. Moreover, the voltage increases must be taken into account in the dimensioning of the high-voltage cable. Furthermore, the high-frequency disturbances can lead to malfunctioning of the X-ray diagnostic equipment containing the X-ray tube, or can affect other electric or electronic apparatus lying within range.

A proposal to counteract these disadvantageous effects of bumping in X-ray tubes of the type described above is described in German 195 00 733 and European Application 0 416 696, by means of passive-damping electrical components, e.g. damping resistors, arranged in the vicinity of the X-ray tube, e.g. in the protective housing surrounding the X-ray tube or in a further housing separate from the protective housing. It is often the case, however, that at least the emitted high-frequency disturbances are still so strong, despite this measure, that they nonetheless affect the X-ray diagnostic equipment containing the X-ray tube, or other electric or electronic equipment lying in the range of the disturbances.

SUMMARY OF THE INVENTION

An object of the present invention is to construct an X-ray tube of the type described above wherein the danger of damage to the anode is further reduced and effects on other equipment are counteracted more strongly.

This object is inventively achieved in an X-ray tube having a vacuum housing, a high-voltage terminal connected with the anode being provided on the housing, and having an electric damping resistor arranged within the vacuum housing, the resistor being connected between the high-voltage terminal and the anode (or the anode's mounting structure in the tube), with the tube current flowing through this resistor.

In relation to the prior art, an improved limitation of the maximum current appearing during bumping is achieved chiefly because during the discharging that occurs during bumping, not only the capacitance of the high-voltage cable, but also the capacitances that belong to the X-ray tube itself and which lie between the end of the high-voltage cable at the tube side and the damping resistor, are decoupled, and thus supply no dielectric displacement current.

Moreover, the voltage "seen" by the anode during bumping of the tube, which without the damping resistor can be on the order of magnitude of a few kilovolts, is substantially reduced.

The damping resistor should have a value no lower than 250 ohms, otherwise a sufficient damping effect is not achieved. As an upper resistance value of the damping resistor, 15 kiloohms should not be exceeded, otherwise an excessive voltage drop appears across the damping resistor.

If the X-ray tube is an X-ray tube having a rotating anode whose anode plate (dish) is connected with a rotor, in an embodiment of the invention for that type of X-ray tube the damping resistor is formed by a component that connects the anode plate with the rotor and through which the tube current flows, this component being formed of a material whose electrical conchannelivity is so low that the connection path between the anode plate and the rotor has a resistance of at least 250 ohms and/or at most 15 kiloohms. During discharging that occurs during bumping, the capacitance of the rotor/vacuum housing capacitor system is then thus also substantially decoupled. In addition, in particular for the case in which the X-ray tube has a metallic vacuum housing, the advantage is achieved that even during arcing from the vacuum jacket to the anode plate, only the capacitance of the anode plate/vacuum housing capacitor system supplies a contribution to the peak current, but not the rotor nor the rotor/vacuum housing capacitor system, nor even the high-voltage cable. The capacitance of the rotor/vacuum housing capacitor system is, moreover, normally almost equally as large as that of the anode plate/vacuum housing capacitor system.

If, in rotating anode X-ray tubes provided with roller bearings, the damping resistor is so arranged that it is located behind the roller bearings, seen in the direction of the flow of current, there also occurs a damping of the emission of those high-frequency disturbances that are produced by brief interruptions of the flow of current occurring in the roller bearings. Such interruptions arise when, as happens stochastically, the roller bearings briefly lose mechanical contact to their paths as a result of the bearing play, and arcs occur between the paths and the roller bodies.

According to an embodiment of the invention, a refractory material (ceramic or ceramic-like material) is used the material for the component connecting the anode plate with the rotor, e.g. silicon nitride, zircon oxide or aluminum oxide. The component connecting the anode plate with the rotor can also be made of one of these materials. Since with the use of a material of this sort a total resistance of the component connecting the anode plate to the rotor can arise that is higher than 15 kiloohms, in an embodiment of the invention the component is at least partially provided with an electrically conchannelive coating containing at least one of the materials gold, molybdenum, palladium, platinum and silver, or is formed from one of these materials. Due to its high heat resistance, molybdenum is particularly suited to withstand the brief, extremely high currents emitted during bumping of the X-ray tube, without damaging the coating.

In addition, from German AS 10 62 828 an X-ray tube with a rotating anode is known in which the anode plate is connected with the rotor by a massive iron axle. The axle ensures that the outflowing quantity of heat in the area of the rotating anode during the operation of the X-ray tube is for the most part conchanneled immediately to the rotor. On the other hand, the temperature peak that occurs during brief loading is absorbed by the heat capacity of the iron axle, so that damage to the bearing of the X-ray tube due to excessively high temperature is avoided. It is also noted that an axle made of ceramic could be used to avoid damage to the bearing due to an excessively high temperature. Such an axle would indeed have low heat conchannelivity, but is not usable in practice due to the risk of breaking. The problem of avoiding uncontrolled electrical discharges in an X-ray tube, in order to avoid damage to the anode surface and to the components connected electrically with the X-ray tube, is not addressed.

According to a preferred embodiment of the invention, the component connecting the anode plate with the rotor is made of silicon carbide and containing carbon. Since the electrical conchannelivity of the material can be influenced by the level of carbon content, the resistance value desired for a particular application can be realized without the necessity of a metallic coating, by the dimensioning of the component itself and/or by suitable selection of the carbon content.

With the use of silicon carbide, as well as the use of other ceramic or ceramic-like materials, for the component connecting the anode plate with the rotor, an additional advantage results, this being a lower heat conchannelivity in relation to the metallic materials usually used herein, e.g. molybdenum, so that a lower operating temperature results for the bearing provided for the mounting of the rotating anode.

In a further variant of the invention the component connecting the anode plate with the rotor is formed from a material of low electrical conchannelivity, e.g. a refractory material (ceramic or ceramic-like material), and has a channel containing a resistance wire that electrically connects the anode plate with the rotor, this wire having a resistance of at least 250 ohms and at most 15 kiloohms. In this embodiment, the component connecting the anode plate with the rotor thus serves only for the mechanical connection, not for the electrical connection. The latter is produced via the resistance wire. In order to ensure that the resistance wire is fixed for the avoidance of unbalanced states or changes in unbalanced states, this wire is contained in a channel. The channel can thereby be formed by a bore or the like, or by a groove.

DESCRIPTION OF THE PREFERRED EMBODIMENTS

Figure 1:
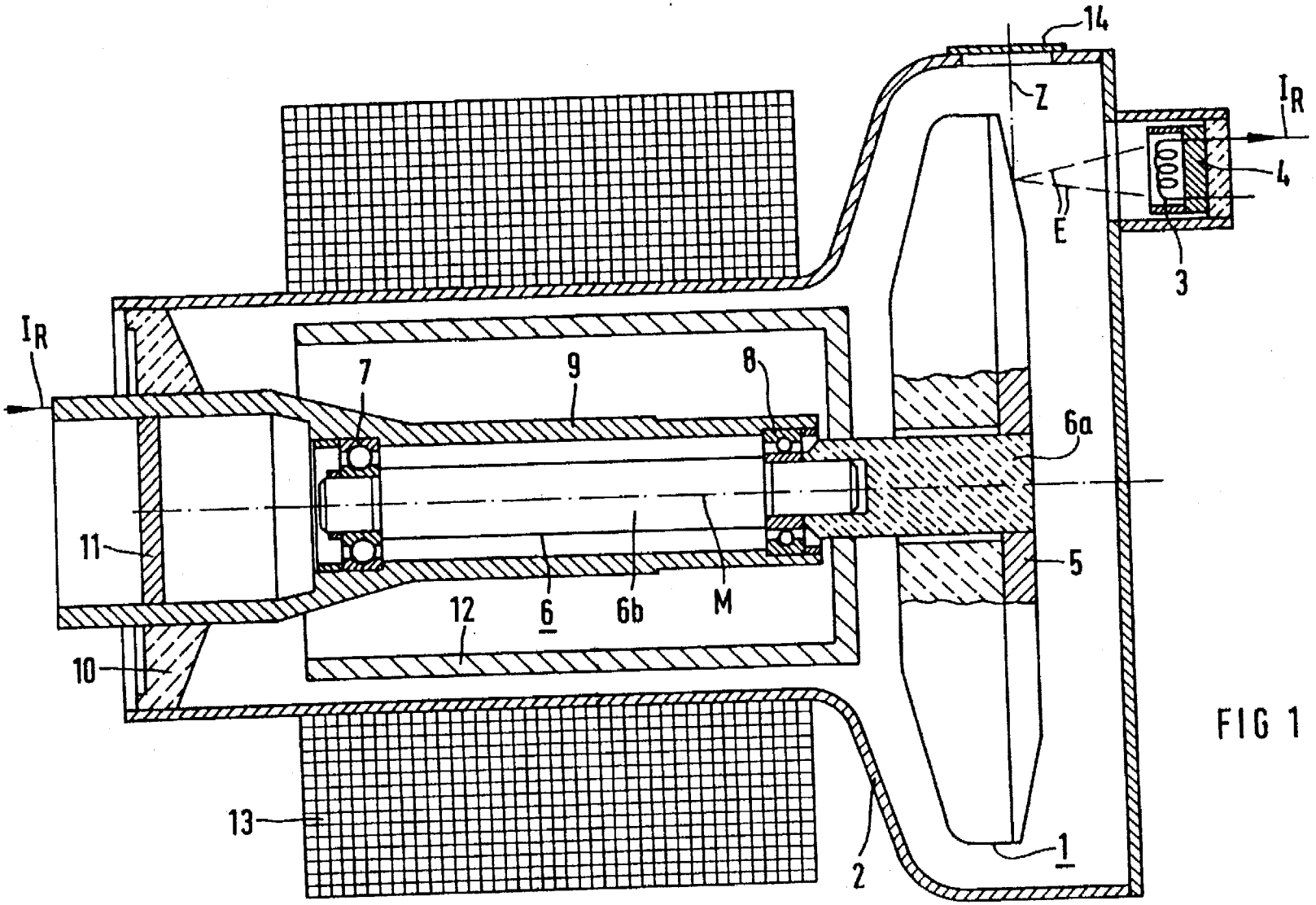
FIG. 1 is a schematic representation of an inventive rotating anode X-ray tube, in longitudinal section.

FIG. 1 shows an X-ray tube having a rotating anode arrangement designated as a whole with 1, housed in a vacuum flask 2. The vacuum flask 2 additionally contains, as is known, a cathode arrangement having a cathode cup 4 in which a spiral filament 3 is contained.

The rotating anode arrangement 1 includes an anode plate 5, fixedly attached to one end of a bearing shaft 6. In order to ensure the rotational mounting of the rotating anode arrangement 1, a bearing arrangement containing two roller bearings 7 and 8 is provided. The outer races of the roller bearings 7 and 8 are contained in the bore of a tube segment 9. This is connected in a vacuum-tight manner with the vacuum flask 2 by means of an annular ceramic part 10. A base 11 is inserted in a vacuum-tight manner in the bore of the tube segment. The roller bearing 7, removed from the anode plate 5, functions as a fixed bearing, and thus can accept forces both in the axial direction, i.e. in the direction of the centeraxis M of the bearing shaft 6, and radial forces, i.e. forces crosswise to the centeraxis M of the bearing shaft 6. The other roller bearing 8 functions as a floating bearing, and thus accepts only radial forces.

In order to enable the rotating anode arrangement 1 to be set into rotation, an electric motor is provided whose rotor 12 is formed by a pot-shaped component of electrically conchannelive material which is fixedly attached to the bearing shaft 6, this component overlapping the end of the tube segment 9 facing the anode plate 5. The schematically shown stator 13 is attached to the outer wall of the vacuum flask 2 in the area of the rotor 12, and, with the rotor 12, forms an electric squirrel-cage motor which, upon supply of the corresponding current, causes the rotating anode arrangement 1 to rotate.

If in a standard way (not shown) the supply current for the driving of the rotating anode arrangement, the heating voltage for the spiral filament 3 of the cathode arrangement and the tube voltage between the cathode arrangement and the rotating anode arrangement 1 is applied, an electron beam E is emitted from the spiral filament 3, which strikes the rotating anode plate 5 in its focus and triggers the emission of X-rays from that location which emerge from the X-ray tube through a radiation exit window 14. The central beam of the X-ray radiation emerging from the radiation exit window 14 is designated Z in FIG. 1. Due to the rotation of the rotating anode arrangement 1, a focus path, of an annular shape, forms on the anode plate 5, since the electron beam E continuously strikes the anode plate 5 at a different place.

In normal operation of the X-ray tube, the tube current $I_R$, as shown schematically in FIG. 1, is supplied via the tube segment 9 and is returned via one of the terminals of the spiral filament 3. The tube current $I_R$ thereby flows through the tube segment 9, the outer races, roll bodies and inner races of the roller bearings 7 and 8, the bearing shaft 6, the anode body 5, the electron beam E and one terminal of the spiral filament 3.

In order to avoid the disadvantages described above, in the case of the inventive X-ray tube the section of the bearing shaft 6 at the anode side, i.e. located between the roller bearing 8 and the anode plate 5, is constructed as a damping resistor.

In the case of the exemplary embodiment according to FIG. 1, this is achieved by the bearing shaft 6 being of bifurcated construction, whereby the shaft part **6*a* at the anode side is formed from silicon carbide containing (suspending) carbon (C/SiC), while the shaft part 6*b* bearing the inner races of the roller bearings 7 and 8** is formed of a metallic material.

The quantity of the carbon distributed in the basic material of the shaft part **6*a* is chosen so that the shaft part 6*a*** represents an electrical resistance, connected between the shaft part 6b and the anode plate 5, on the order of magnitude of a few 100 ohms to a few kiloohms, preferably on the order of magnitude of 1 kiloohm.

Since the tube current $I_R$ flows through this resistor, it operates as a damping resistor located within the X-ray tube, with the advantages already explained.

The connection of the two shaft parts 6a and 6b with one another, as well as the connections of the shaft part 6a with the anode plate 5, can ensue by means of a press connection or by means of soldering.

Figure 2:
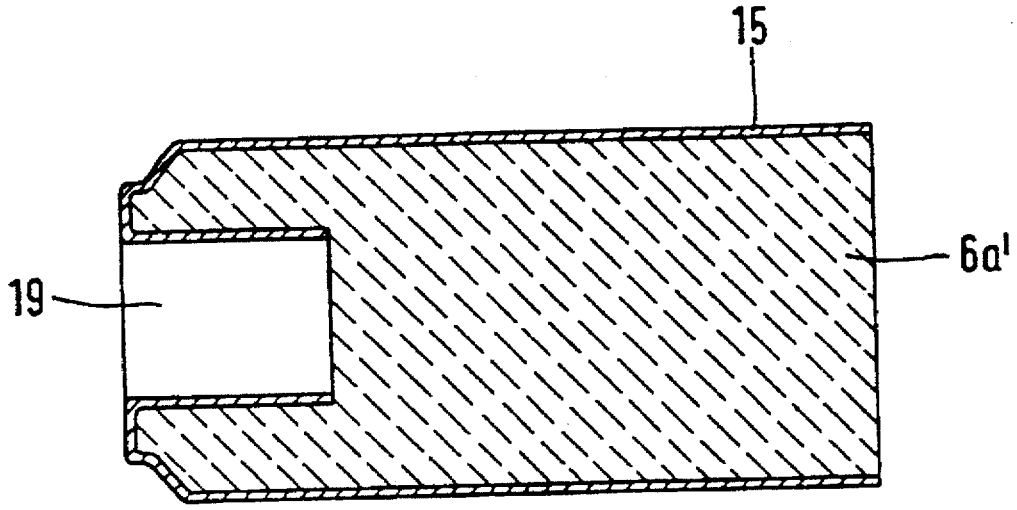
FIGS. 2 to 4 respectively show enlarged representations of details of further embodiments of the inventive rotating anode X-ray tube.

Deviating from the above-described exemplary embodiment, the shaft part 6a can alternatively be formed of an electrically insulative refractory material, e.g. a ceramic or a ceramic-like material, e.g. silicon carbide, zircon oxide or aluminum oxide, as is the case in the shaft part 6a', shown in FIG. 2. In order to achieve a component that represents a resistor of the desired order of magnitude, it is provided, except on its front surface at the anode side and the innermost surface of the opening 19 provided for accepting the shaft part 6b, with an electrically conchannelive coating 15, containing at least one of the materials gold, molybdenum, palladium, platinum and silver.

Figure 3:
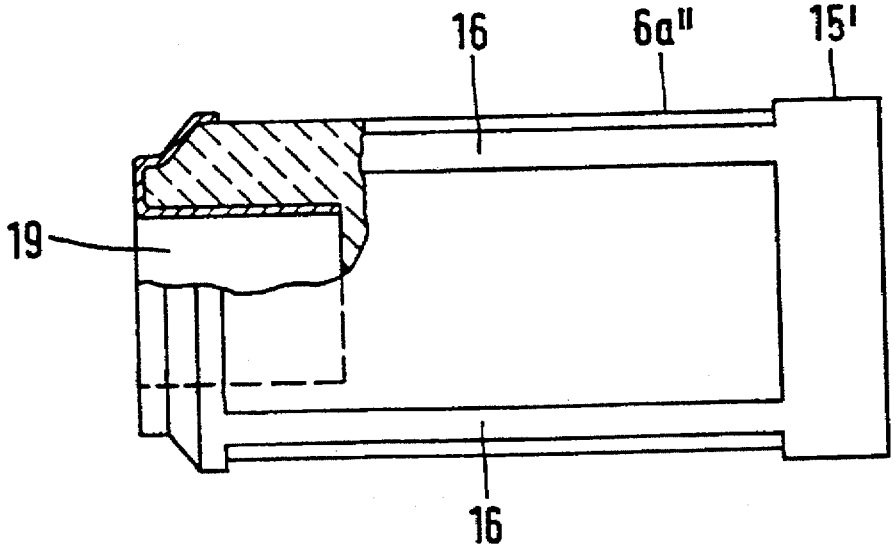

In the embodiment according to FIG. 2, it is possible to influence the resistance value of the shaft part 6a', apart from the selection of material, by the selection of a corresponding thickness of the coating 15. If the desired resistance value should be realizable only with an extremely thin (and thus difficult to manufacture under some circumstances) coating 15, there is the possibility, as shown in FIG. 3 by means of the example of the shaft part 6a", of leaving open the coating 15' at least in the area of the shaft part's outer coating surface in such a way that at least one electrically conchannelive strip 16 is present, which connects the remaining areas of the coating 15'. These remaining areas serve for electrically contacting the shaft part 6b and the anode plate 5 with one another. In the case of FIG. 3, three strips 16 are provided, of which two are visible.

Figure 4:
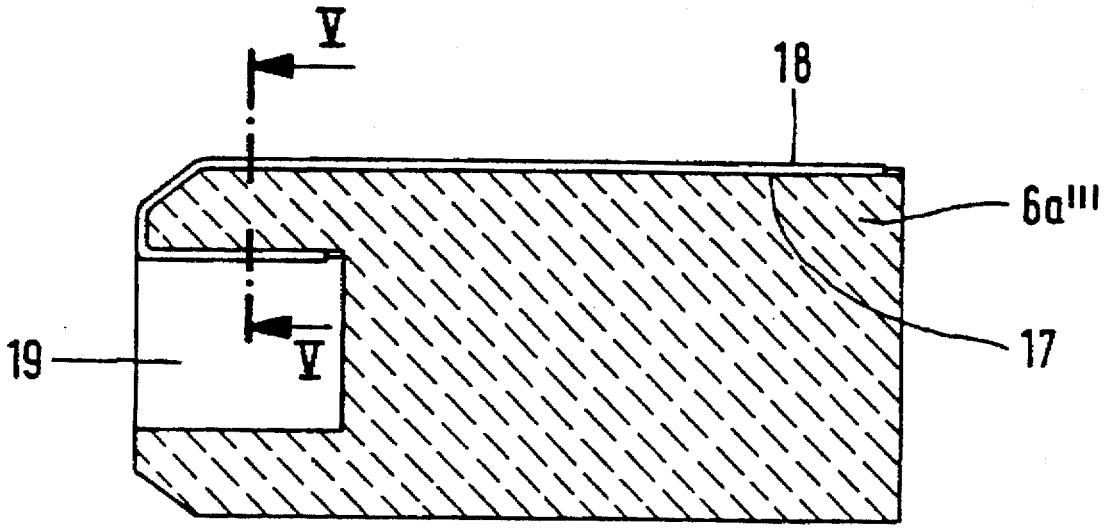
Figure 5:
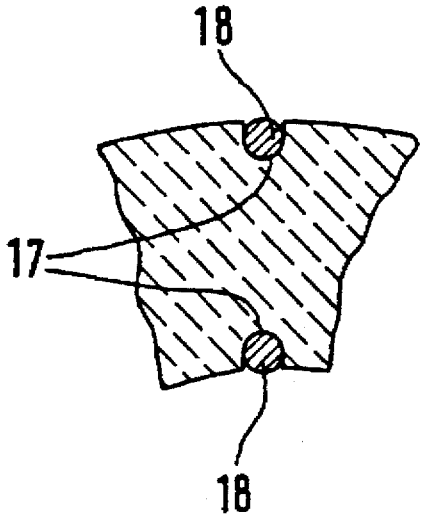
FIG. 5 is a section along the line V—V in FIG. 4, in a further enlarged representation.

As an alternative to a coating, it is possible, as shown in FIGS. 4 and 5, to provide the shaft part 6a'" with a groove 17 in which is fixed (e.g. by soldering) a resistance wire of a suitable resistance value, which serves for the electrical connection of the shaft part 6b with the anode plate 5. It is provided according to FIG. 4 that the groove 17, and the resistance wire 18 accepted in the groove, extend over the wall of the opening 19 provided for the acceptance of the shaft part 6b, over the adjacent front surface of the shaft part 6a" and over its entire outer coating surface. In the case of the exemplary embodiment shown in FIGS. 4 and 5, the entire groove 17 lies in one plane. It is also possible, if required for the realization of a determined resistance value, in particular a larger one, to construct the groove 17, in particular in the area of the outer coating surface of the shaft part 6a'", in such a way that a longer length of the resistance wire results. For example, the groove 17 can be constructed in the manner of a helical line.

The connection of the shaft part 6a" with the shaft part 6b on one side and with the anode plate 5 on the other side can ensue by soldering, in such a way that the resistance wire 18 is incorporated into the soldering connection. Alternatively, for the case in which the resistance wire 18 extends slightly past the groove 17, it is possible to provide press connections in place of soldered connections.

Where useful, several resistance wires 18 electrically connected in parallel can be provided, each of which is accepted in a groove 17.

Figure 6:
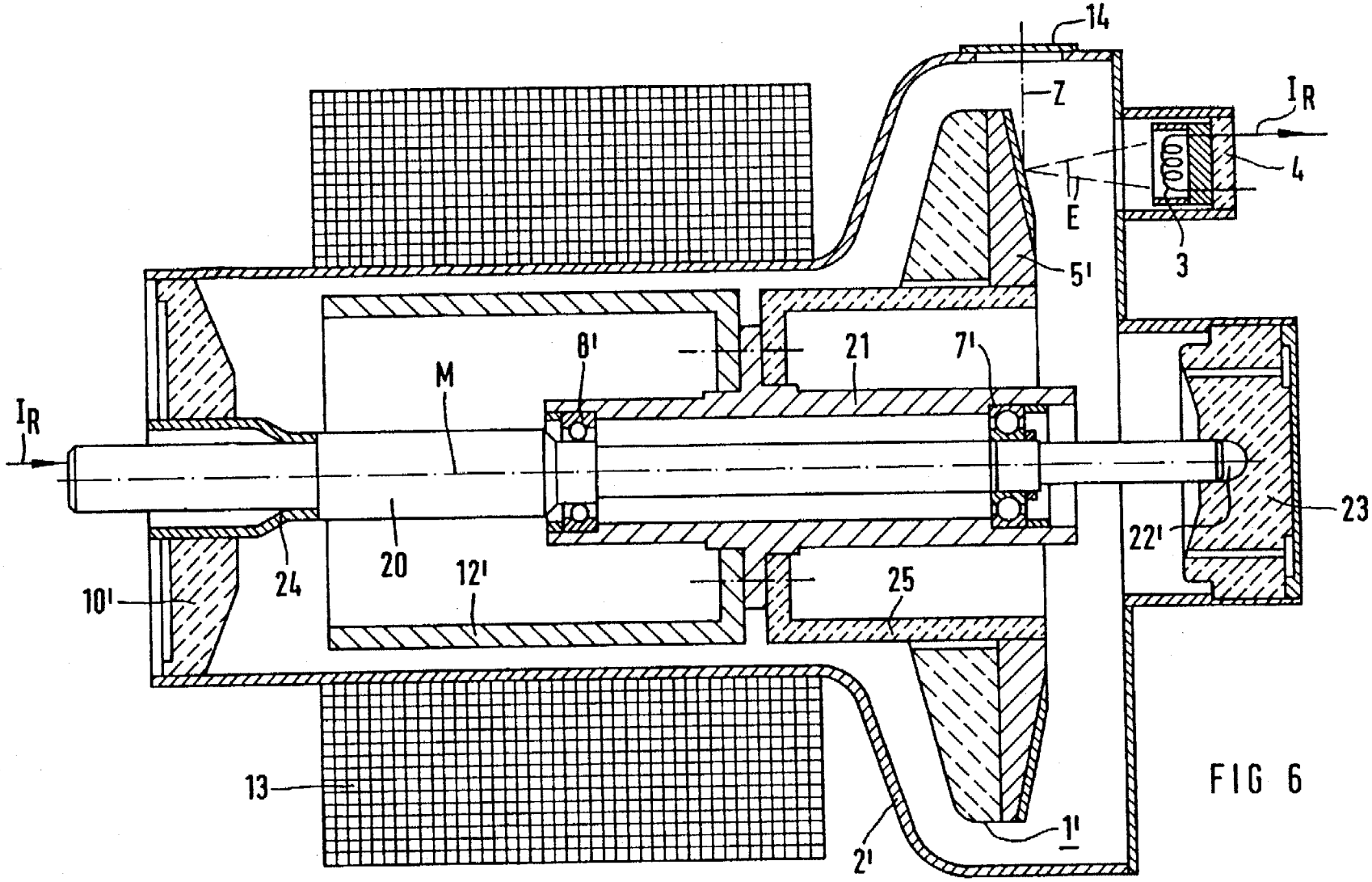
FIG. 6 shows a modified version of an inventive rotating anode X-ray tube in longitudinal section.

In the case of the exemplary embodiment according to FIGS. 1 to 5 the rotating anode arrangement 1 is provided with bearings on one side; in the case of the exemplary embodiment according to FIG. 6 the X-ray tube has a rotating anode arrangement 1' having bearings on both sides. The rotating anode arrangement 1' is rotationally provided with bearings on a stationary bearing axle 20 by means of two roller bearings 7' and 8'.

The bearing axle 20 is connected via a metallic shell 24 with an annular ceramic component 10', which is inserted vacuum-tight into the vacuum housing 2', and at the other side is inserted into the opening 22 of an annular ceramic component 23, which is accepted in a corresponding pot-shaped projection of the vacuum housing 2'.

The anode plate 5' of the rotating anode arrangement 1' is attached to a tubular component 25. This is connected with a bearing shell 21, commonly with a rotor 12', via a flange joint (the screws are shown only as broken lines). The outer races of the roller bearings 7' and 8' are accepted in the shell's bore. In a way analogous to FIGS. 1 to 5, the roller bearing 7' is constructed as a fixed bearing and the roller bearing 8' is constructed as a floating bearing.

In the case of the X-ray tube according to FIG. 6, the transmission of the tube current $I_R$ thus ensues via the bearing axle 20, the inner races, roller bodies and outer races of the roller bearings 7' and 8', the bearing shell 21, the component 25, the anode plate 5', the electron beam E and one terminal of the glow cathode 3.

The component 25 is formed in a way similar to the shaft part 6a in the exemplary embodiment according to FIG. 1, from silicon carbide with carbon distributed therein in an amount required to achieve the desired resistance value. The component 25 thus represents, as does the shaft part 6a, a damping resistor located within the X-ray tube, connected immediately in front of the anode.

Figure 7:
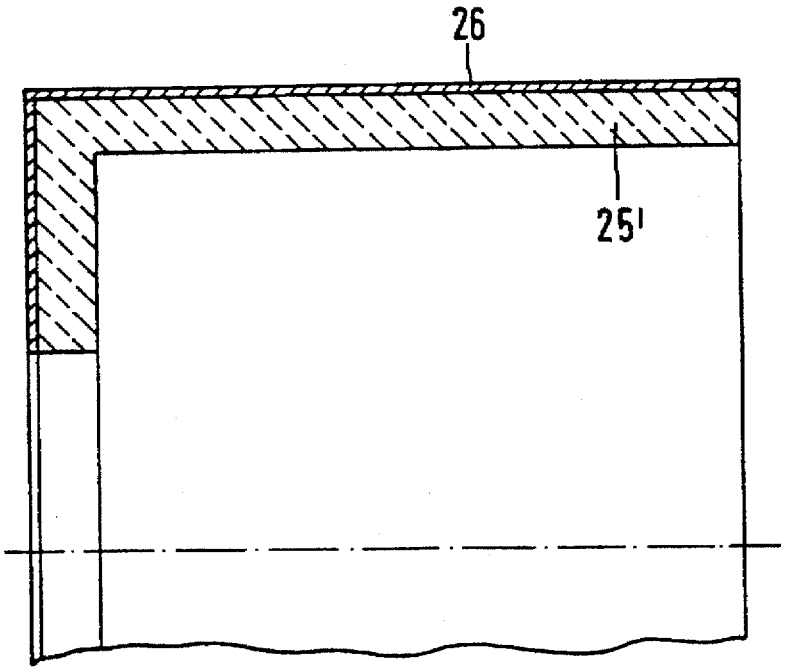
FIGS. 7 and 8 respectively show enlarged representations of details of further embodiments of the inventive rotating anode X-ray tube.
Figure 8:
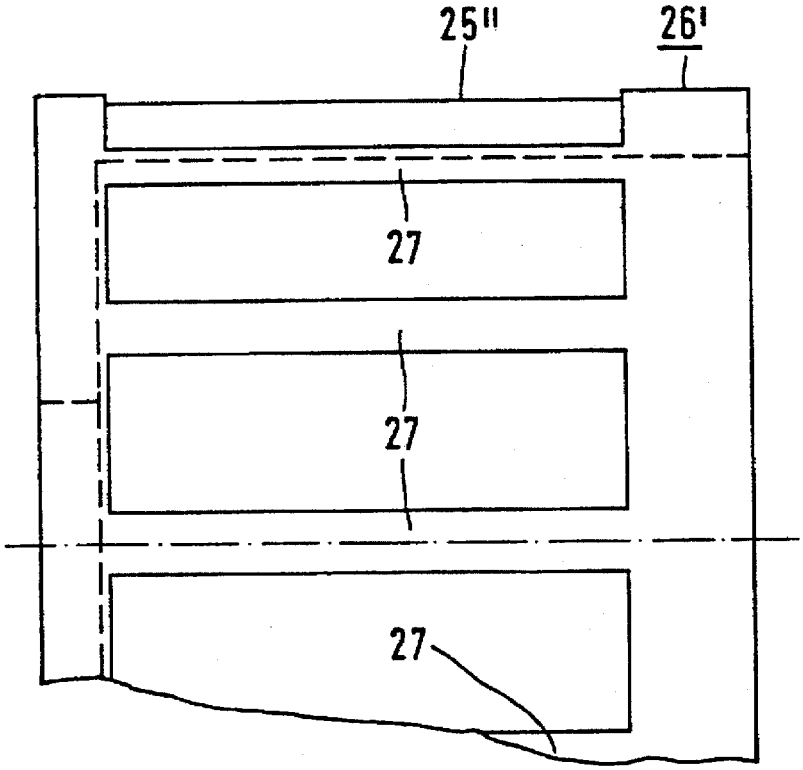

In the X-ray tube according to FIG. 6, there also exists the possibility, analogously to the embodiments according to FIGS. 2 and 3 of instead of forming the component 25 from silicon carbide distributed with carbon, forming it from an electrically insulative material (for suitable materials, reference is made to the exemplary embodiments described above). It is also possible, as in the case of the component 25' represented in FIG. 7, to provide the component 25 with an electrically conchannelive coating 26 made of one of the already-identified materials or, as in the case of the component 25" shown in FIG. 8, to divide the coating 26' into strips 27 in the area of the outer coating surface of the component 25".

In the case of the X-ray tube according to FIG. 6, there is also the possibility of producing the electrical connection of the anode plate 5' with the bearing shell 21 by means of a resistance wire accepted in a channel, e.g. a groove.

The distribution of carbon within the silicon carbide material can ensue in a known way.

The coatings 15 and 15', as well as 26 and 26', can be produced by means of standard coating and masking methods.

In the specified exemplary embodiments, the X-ray tubes are constructed as rotating anode X-ray tubes, however, the invention can also be used with fixed anode X-ray tubes.

In addition, in the case of the specified exemplary embodiments the free end of the tube segment 9, or of the bearing shaft 20, functions as a high-voltage terminal connected with the anode to which the high-voltage plug connected to the high-voltage cable serving for the supply of the anode current can be attached.

Although modifications and changes may be suggested by those skilled in the art, it is the intention of the inventors to embody within the patent warranted hereon all changes and modifications as reasonably and properly come within the scope of their contribution to the art.

I claim as my invention:

1. An X-ray tube comprising:

a vacuum housing;

a cathode arrangement and an anode arrangement disposed in said vacuum housing;

a high-voltage terminal electrically connected to said anode arrangement and mounted on said vacuum housing so as to be accessible from an exterior of said vacuum housing; and an electrical damping resistor disposed inside said vacuum housing and connected between said high-voltage terminal and said anode arrangement and through which a tube current flows when a high-voltage is supplied to said high-voltage terminal.

2. An X-ray tube as claimed in claim 1 wherein said anode arrangement comprises a rotating anode arrangement including an anode plate mounted on a rotor and means for rotating said anode plate and rotor, and wherein said damping resistor comprises a component connecting said anode plate to said rotor and forming a path for said tube current between said anode plate and said rotor having an electrical resistance in a range from 250 ohms to 15 kiloohms.

3. An X-ray tube as claimed in claim 2 wherein said component contains electrically insulating material.

4. An X-ray tube as claimed in claim 2 wherein said component contains refractory material.

5. An X-ray tube as claimed in claim 4 where in said refractory material comprises material selected from the group consisting of silicon nitride, zircon oxide and aluminum oxide.

6. An X-ray tube as claimed in claim 5 wherein said component comprises an electrically conchannelive coating at least partially covering an exterior of said component.

7. An X-ray tube as claimed in claim 2 wherein said component is comprised of a material selected from the group consisting of silicon nitride, zircon oxide and aluminum oxide.

8. An X-ray tube as claimed in claim 7 wherein said component comprises an electrically conchannelive coating at least partially covering an exterior of said component.

9. An X-ray tube as claimed in claim 7 wherein said coating comprises a material selected from the group consisting of gold, molybdenum, palladium, platinum and silver.

10. An X-ray tube as claimed in claim 2 wherein said component contains silicon with carbon distributed therein.

11. An X-ray tube as claimed in claim 10 wherein said component is comprised of silicon with carbon distributed therein.

12. An X-ray tube as claimed in claim 2 wherein said component comprises a refractory material having carbon distributed therein.

13. An X-ray tube as claimed in claim 1 wherein said anode arrangement comprises a rotating anode arrangement including an anode plate mounted on a rotor and means for rotating said anode plate and rotor, and wherein said damping resistor comprises a component connecting said anode plate and said rotor, said component comprising an electrically insulating element having a channel therein and an electrically conchannelive wire disposed in said channel and electrically connecting said anode plate and said rotor, said wire having a resistance in a range between 250 ohms and 15 kiloohms.

* * * * *